343-909 SR
7/10/84 XR 4,459,596

United States Patent [19]

Flam

[11] Patent Number: 4,459,596

[45] Date of Patent: Jul. 10, 1984

[54] COAXIAL ANTENNA CONFIGURATION WITH HIGH INTER-ELEMENT ISOLATION

[75] Inventor: Richard P. Flam, Horsham, Pa.

[73] Assignee: General Instrument Corporation, New York, N.Y.

[21] Appl. No.: 284,595

[22] Filed: Jul. 20, 1981

[51] Int. Cl.[3] ..... H01Q 1/52; H01Q 1/36

[52] U.S. Cl. ..... 343/895; 343/909

[58] Field of Search ..... 343/895, 909, 844, 853

[56] References Cited

U.S. PATENT DOCUMENTS

| | | | |
|---|---|---|---|
| 3,599,220 | 8/1971 | Dempsey | 343/895 |
| 3,683,385 | 8/1972 | Corzine et al. | 343/895 |
| 3,710,333 | 1/1973 | Crom | 343/895 |
| 3,735,409 | 5/1973 | Gershberg et al. | 343/895 |
| 4,095,230 | 6/1978 | Salmond et al. | 343/895 |

*Primary Examiner*—Eli Lieberman

*Attorney, Agent, or Firm*—Hopgood, Calimafde, Kalil, Blaustein & Judlowe

[57] ABSTRACT

A two-antenna array includes first and second coaxial antenna members spaced such that the fore member is in the distant (far) front lobe field of the aft element. Each antenna member includes a like-oriented circularly polarized antenna element with microwave absorbing material disposed in a cavity about its aft, back lobe direction.

A high degree of electrical isolation exists between antennas by reason of the aggregate inter-element transmission losses resulting from (i) space propagation loss, (ii) antenna front-to-back discrimination, and (iii) polarization isolation.

7 Claims, 2 Drawing Figures

COAXIAL ANTENNA CONFIGURATION WITH HIGH INTER-ELEMENT ISOLATION

DISCLOSURE OF THE INVENTION

This invention relates to electromagnetic wave radiation and, more specifically, to proximately located antennas characterized by a high degree of electrical isolation therebetween.

There are many applications of present interest where multiple, highly isolated electrical antennas are desirable in close proximity to one another—as on the same powered or ballistic moving vehicle. Such a desideratum have application, for example, in transmit/receive antennas for companion transmissions each operative for a like polarization radiation (e.g., a radar emission and reflected return; incoming and outgoing emissions in an electronic countermeasures context, or the like).

It is an object of the present invention to provide an improved antenna arrangement.

More specifically, it is an object of the present invention to provide an improved arrangement of plural closely spaced and highly isolated broad band antennas.

The above and other objects of the present invention are realized in a specific, illustrative two-antenna array comprising first and second coaxial antenna members. Each antenna member includes a like-oriented circularly polarized antenna element with microwave absorbing material containing cavity about its back lobe direction. The two members are spaced such that the fore antenna is in the distant (far) front lobe field of the aft element.

A high degree of electrical isolation exists between the two antennas by reason of the aggregate losses resulting from (i) space loss, (ii) back lobe discrimination, enhanced by the absorber, and (iii) polarization isolation.

Figure 1:
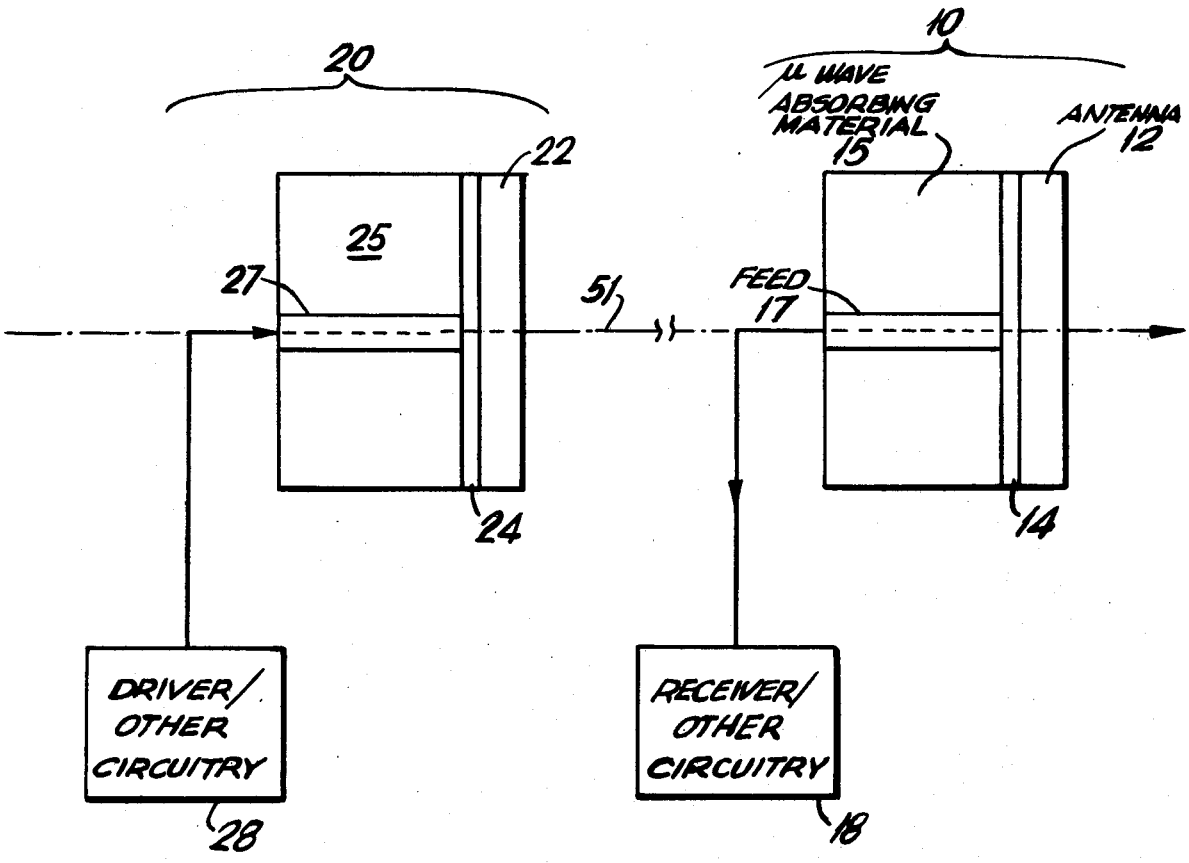
Figure 2:
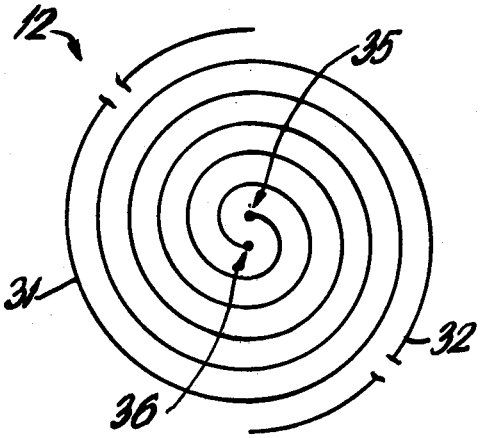

The above and other advantages of the present invention will become more clear from the following detailed description of a specific illustrative embodiment thereof presented hereinbelow in conjunction with the accompanying drawing in which:

FIG. 1 is a schematic view of two coaxial antenna members 10 and 20 in accordance with the principles of the present invention; and FIG. 2 is a schematic plan view of radiating antenna elements employed in the FIG. 1 arrangement.

As above noted, it is highly desirable in many present day applications to have two radiating, or radiating-/receiving antenna elements operative for like polarization waves mounted in close proximity and, preferably, aligned, with high electric isolation between the two elements. Such a configuration is shown in FIG. 1 and includes two composite antenna members 10 and 20 having a common central axis 51. Examining in detail the fore or front antenna member 10 (which is identical to the aft antenna member 20), the apparatus 10 includes a symbolically illustrated radiating antenna element 12 (shown in plan view in FIG. 2) secured to a plastic mechanical cushioning layer 14 of any common type, e.g., a plastic foam. The prominent or front lobe of the antenna 12 is to the right in FIG. 1, i.e., in the "fore" direction. Disposed to the rear of antenna element 12 in a per se conventional reflecting cavity (not shown) is a body of a microwave absorbing material 15. Such microwave absorbing materials are per se well known, examples being ferrite, a carbon loaded honeycomb structure, or the like. The absorbing material 15 may be omitted for a lower isolation application.

Passing through the microwave absorbing material 15 is an antenna feed 17, e.g., a coaxial cable, tapered strip line or the like as appropriate for the specific frequency range of the radiating element 12, the antenna 12 and antenna feed 17 being connected to electronic circuitry 18 of any known kind. For purposes of illustration only and not limitation, it is assumed that the composite antenna member 10 serves as a signal receiver while the member 20 functions as a signal radiating element. Obviously, any other combination of assignments for the two antennas 10 or 20 may also be effected by the instant invention. With the above assumption, circuitry 18 connected to feed 17 for antenna 12 is identified as receive circuitry, while circuitry 28 connected to antenna 20 is ascribed a drive function.

One very useful antenna form in accordance with the principles of the present invention is the circularly polarized spiral antenna 12 shown in FIG. 2. Such an antenna includes two inter-leaved spiraling conductors 31 and 32 center fed at conducting points 35 and 36. In one advantageous form of the antenna, the conductors 31 and 32 with connection lands 35 and 36 are formed by printed circuit techniques on any conventional insulating substrate, e.g., a ceramic or glass. The feed 17 is, of course, merely connected to the lands 35 and 36 for a receive/drive connection to the antenna.

The antenna 20 is identical to the antenna 10, comparable elements simply being identified by digits in a 20-series vis-a-vis the 10-series associated with the antenna 10.

Two coaxial antenna of conventional types have not heretofore been used since radiation from one of the antennas would couple into the other. However, the antenna configuration of applicant's arrangement is characterized by a very high degree of electrical isolation between the two active antennas 12 and 22. This isolation (which can be on the order of 70 db) follows from three principal physical mechanisms. First, there is a space loss between the two antennas directly proportional to the square of the distance between them. To illustrate just one case for realistic coaxial spacings with the fore antenna 10 being substantially in the far field of the first, a space loss of approximately 29 db would result from a 3 inch inter-element spacing at an operative frequency of 7 Ghz.

As a second loss causing mechanism, the front-to-back ratio imparted by the cavity and absorbing layer 15 imparts on the order of an additional 20 db of isolation.

Finally, yet on the order of another 20 db of isolation results from the mismatched front/back polarization selectivity between the antennas 12 and 22. More specifically, the antennas 12 and 22 have the same polarization (i.e., spiral direction) when viewed from the front (or back) of the composite antenna array. However, the antenna 22 when viewed from the rear of antenna 12 or, conversely, the rear of antenna 12 when viewed from the front of antenna 22 have oppositely polarized spirals and thus there is minimal coupling between them. The polarization mismatch loss (isolation) ($L_p$) between the two antennas 12 and 22 is given by:

$$L_P = -10 \log_{10}\left\{\frac{1}{2} + \frac{1}{2}\left[\frac{4\alpha_T\alpha_R + (1-\alpha_T^2)\cos(2\beta)}{(1+\alpha_T^2)(1+\alpha_R^2)}\right]\right\}$$

where:

$\alpha_T$=Axial ratio (major axis/minor axis) expressed as a voltage ratio $(=10^{\alpha_T(dB)/20})$ for the transmit antenna $\alpha_R$=Axial ratio (major axis/minor axis) expressed as a voltage ratio $(=10^{\alpha_R(dB)/20})$ for the receive antenna $\beta$=Polarization mismatch angle (i.e. angle between the major axes of the transmit and receive polarization ellipses) $(0 \leqq \beta \leqq 90°)$ For "right hand" sense of elliptical polarization $\alpha_T$ or $\alpha_R$ are positive numbers; for "left hand" they are negative numbers.

Accordingly, aggregating all of the isolation mechanisms of FIG. 1, on the order of 70 db isolation results between the two active antenna elements 12 and 22, thus permitting their reasonable close, coaxial spacing without undue coupling. Moreover, as is per se well known, spiral antennas are broadband devices, thus permitting great flexibility in communications applications. As just one example, such a spiral antenna could well broadly cover a frequency range of 2 Ghz to 18 Ghz.

In accordance with aspects of the present invention, the spiral antenna of FIG. 2 could be replaced with other antenna forms emitting circularly polarized radiation. Thus, for example, so-called circularly polarized horn, reverse back fire, or like antennas may be useful for proximate antennas.

The above described arrangements are merely illustrative of the principles of the present invention. Numerous modifications and adaptations thereof will be readily apparent to those skilled in the art without departing from the spirit and scope of the present invention.

What is claimed is:

1. In combination in an antenna array, first and second antenna means coaxially arranged on a common axis and spaced on said axis from one another, each of said antenna means including circularly polarized antenna elements having a fore, front-lobe side and a back, rear-lobe side, the front-lobe sides of said first and second antenna elements being directed in the same direction, said antenna elements being similarly polarized, wherefore said two antenna means are characterized by polarization isolation.

2. A combination as in claim 1 wherein said common axis is an axis of symmetry for said antenna means.

3. A combination as in claim 1 or 2 wherein said first and second circularly polarized antenna elements comprise spirals of common polarization.

4. A combination as in claim 1 or 2 further comprising wave absorbing means on the back side of said antenna elements.

5. A combination as in claim 1 or 3 wherein said second antenna is in the far field of said first antenna.

6. A combination as in claim 3, 4 or 5 wherein each of said antenna elements comprises two interleaved conductive spirals of a like polarity.

7. A combination as in claim 6 wherein said conductive spirals are disposed on a non-conductive substrate.

* * * * *